US005561829A

United States Patent [19]

Sawtell et al.

[11] Patent Number: 5,561,829

[45] Date of Patent: Oct. 1, 1996

[54] METHOD OF PRODUCING STRUCTURAL METAL MATRIX COMPOSITE PRODUCTS FROM A BLEND OF POWDERS

[75] Inventors: Ralph R. Sawtell, Monroeville; Warren H. Hunt, Jr., Export; Thomas J. Rodjom, Murrysville, all of Pa.; Erik J. Hilinski, Cleveland Heights, Ohio; John H. Milsom, Apollo, Pa.

[73] Assignee: Aluminum Company of America, Pittsburgh, Pa.

[21] Appl. No.: 430,107

[22] Filed: Apr. 27, 1995

Related U.S. Application Data

[63] Continuation of Ser. No. 96,317, Jul. 22, 1993, abandoned.

[51] Int. Cl.[6] ..... B22F 1/02

[52] U.S. Cl. ..... 419/13; 419/14; 419/15; 419/19; 419/23; 419/28; 419/35; 419/64; 75/232; 75/233; 75/235; 75/236; 75/237; 75/246; 75/247; 75/249

[58] Field of Search ..... 419/13, 14, 15, 419/19, 23, 28, 35, 64; 75/232, 233, 235, 236, 237, 246, 247, 249

[56] References Cited

U.S. PATENT DOCUMENTS

| | | | |
|---|---|---|---|
| 3,954,458 | 5/1976 | Roberts | 75/200 |
| 4,063,940 | 12/1977 | Dain et al. | 75/213 |
| 4,104,061 | 8/1978 | Roberts | 75/211 |
| 4,435,213 | 3/1984 | Hildeman et al. | 75/249 |
| 4,460,541 | 7/1984 | Singleton et al. | 419/42 |
| 4,537,167 | 8/1985 | Eudier et al. | 123/193 |
| 4,575,450 | 3/1986 | Meunier | 419/41 |
| 4,587,096 | 5/1986 | Mankins et al. | 419/27 |
| 4,597,792 | 7/1986 | Webster | 75/249 |
| 4,609,526 | 9/1986 | Haswell et al. | 419/23 |
| 4,661,154 | 4/1987 | Faure | 75/231 |
| 4,693,864 | 9/1987 | Lloyd | 419/23 |
| 4,711,823 | 12/1987 | Shiina | 428/547 |
| 4,722,751 | 2/1988 | Akechi et al. | 75/232 |
| 4,923,671 | 5/1990 | Aslund | 419/8 |
| 4,992,238 | 2/1991 | Couper et al. . | |
| 5,009,842 | 4/1991 | Hendrickson et al. | 419/28 |
| 5,015,289 | 5/1991 | Toda et al. | 75/229 |
| 5,183,632 | 2/1993 | Kiuchi et al. | 419/48 |

*Primary Examiner*—Charles T. Jordan
*Assistant Examiner*—Daniel Jenkins
*Attorney, Agent, or Firm*—David W. Pearce-Smith

[57] ABSTRACT

A method of preparing a metal alloy product from a powder blend. The method comprising: (a) cold pressing a blend to form a compact, the metal blend comprising a metal powder phase and at least one reinforcement phase having a hardness greater than the metal phase; (b) heating the compact to form a preheated compact; and (c) hot working the heated compact. In a preferred method, the powder metal blend comprises 50 to 90 vol. % of an aluminum alloy powder and 10 to 50 vol. % of silicon carbide; the heating of the compact perforated in a nitrogen atmosphere to form a preheated compact; and the extruded hot compact is hot worked. Hot working may take the form of forging, rolling, upset forging, exuding, compacting or other processes known in the art.

30 Claims, 3 Drawing Sheets

METHOD OF PRODUCING STRUCTURAL METAL MATRIX COMPOSITE PRODUCTS FROM A BLEND OF POWDERS

This application is a continuation of application Ser. No. 08/096,317, filed Jul. 22, 1993, now abandoned.

TECHNICAL FIELD

The present invention relates to methods for producing metal alloy products from particulate starting materials. More particularly, the method relates to methods of producing metal alloy products containing reinforcement materials. The present methods are particularly adapted for use with aluminum and aluminum alloy wrought products and their manufacture involving the use of powdered starting materials.

BACKGROUND ART

In recent years, powder metallurgy has been gaining increasing attention in efforts to obtain new microstructures and improved mechanical properties in alloys of aluminum. In adapting powder metallurgy to the manufacture of wrought products, the idea has been one of consolidating a powder to form a basic workpiece which often corresponds to the usual ingot or billet. Ideally, the workpiece can then be hot worked according to conventional methods to produce the desired wrought mill product, such as an extrusion, or forging or sheet.

To produce a workpiece of suitable quality, it has been recognized that the powder should be consolidated in a closely controlled manner. Care is needed, for example, to minimize internal workpiece contamination by oxidation, hydration or other reactions with extraneous elements or compounds. Further, in the known art of processing aluminum powder alloys is the stringent care that has been exercised in order to minimize internal workpiece porosities, particularly porosities which trap gases at any significant pressure.

A problem which is unique to aluminum powder metallurgy is the inevitable formation of oxides on the powder. These oxides form as thin films, on the order of several nanometers in thickness, on the surfaces of the individual particles. Unlike the oxides which form on other metals used in powder metallurgy, such as copper, iron and their alloys, the oxide film on aluminum or magnesium cannot be reduced to metal in situ. The oxide film on aluminum and its alloys consists almost exclusively of aluminum and magnesium oxides and their hydrates. These aluminum or magnesium oxide films inhibit the particle-to-particle bonding necessary in forming both good compacts and final products of acceptable ductility and toughness as well as strength. Thus, the formation of aluminum powder products is far more difficult and technically completely distinct from the powder metallurgy of metals with in-situ reducible oxides, such as copper, iron and their alloys.

According to a common prior art practice, consolidation of aluminum powders is carried out in the following manner. First, a porous compact is formed by cold isostatic pressing the powder to about 70% of the theoretical density of the alloy being used. Then the compact is encapsulated in a closely fitting aluminum alloy container or can. For degassing purposes, air is then evacuated from the can and the compact is heated to about 520° C. for about 6 to 7 hours in a high vacuum. While this temperature and vacuum continue to be maintained inside the can, the canned compact is sealed and then compressed to full density at pressures above about 140 MPa. (620 MPa is generally used.)

The compact is then cooled and the container is machined away to expose uncontaminated but fully consolidated billet. Removal of the container is necessary but costly step, since the container is typically formed from an alloy that is compositional different than the powder blend used to form the billet. In addition, since the container typically buckles during compaction the final machined billet size is often greatly reduced compared to the initial diameter of the consolidated powder to insure that all of the container is removed, resulting in reduced product recovery. The billet is then heated and extruded in a conventional manner to produce a wrought product or is otherwise hot worked as by forging.

Variations of this practice are disclosed in U.S. Pat. No. 4,104,061 to S. G. Roberts. During heat-up of the compact for degassing, the container may be evacuated by vacuum, back filled with a depurative gas such as dry nitrogen, and again vacuum evacuated to facilitate the overall degassing process. In addition, the powder can be packed directly into the container, whereby the initial step of cold forming a compact is simply omitted. The hot consolidating step cannot be omitted.

Thus, in the foregoing practice and variations thereof, the use and removal of a container and the use and removal of a vacuum are seen as essential and costly steps.

It has also been known to place aluminum alloy powder in a vacuum hot press, degas the powder as placed in the press, and then hot press the powder to a near solid mass. This process is expensive because of the complex equipment used and the low production rate. Degassing is oftentimes difficult since usually only one end of the powder column is exposed to the vacuum. In vacuum hot pressing the intent is to hot press to 100% density; the result usually is a product of density 96% or more of theoretical.

It was against this background that the development of the present invention came about.

The primary object of the present invention is to provide a method for consolidating aluminum powder without the need for the use and removal of an aluminum alloy container which results in mechanical properties comparable to those produced by the above-described prior art process.

Another object of the present invention is to provide a method for consolidating aluminum powder without the need for the application of a vacuum.

Another objective of the present invention is to provide a method for consolidating aluminum powder without the need for a vacuum hot press.

These and other objects and advantages of the present invention will be more fully understood and appreciated with reference to the following description.

SUMMARY OF THE INVENTION

This invention concerns powder metallurgy and is aimed at making a workpiece, such as a billet or the like, which is suitable for being hot worked to produce a wrought metal product. In a process of this invention the following sequential steps are involved: (a) cold pressing a powder metal blend to form a compact, the powder metal blend comprising a metal powder; and at least one reinforcement phase having a hardness greater than said metal (b) heating the compact in the presence of air or an inert gas to form a preheated compact; and (c) hot working the hot compact. The temperatures used to heat the compact as well as the temperature at which hot compacting take place will vary with the composition of the alloy.

In a preferred method the powder metal blend comprises 50 to 90 vol. % of an aluminum alloy powder and 10 to 50 vol. % of silicon carbide; hot compacting the blend to a shape in the rough configuration of the final product; the heating of the compact performed in a nitrogen atmosphere at a temperature of about 800° F. to about 900° F. to form a preheated compact; and the hot compact is forged. Hot working may take the form of forging, extruding, hot compacting, rolling or other processes known in the art. After hot working the material may then be given a heat treatment and artificial age to achieve the desired properties.

BRIEF DESCRIPTION OF THE DRAWINGS

Other features of the present invention will be further described in the following related description of the preferred embodiment which is to be considered together with the accompanying drawings wherein like figures refer to like parts and further wherein.

MODE FOR CARRYING OUT THE INVENTION

The term "full density" is used herein to mean a density greater than 95% of theoretical density.

The term "compact" is used herein to mean an intermediate product form which has not been compressed to full density. A compact may be an axisymetric billet shape or near net shape or any other shape advantageous to downstream processing.

Figure 1:
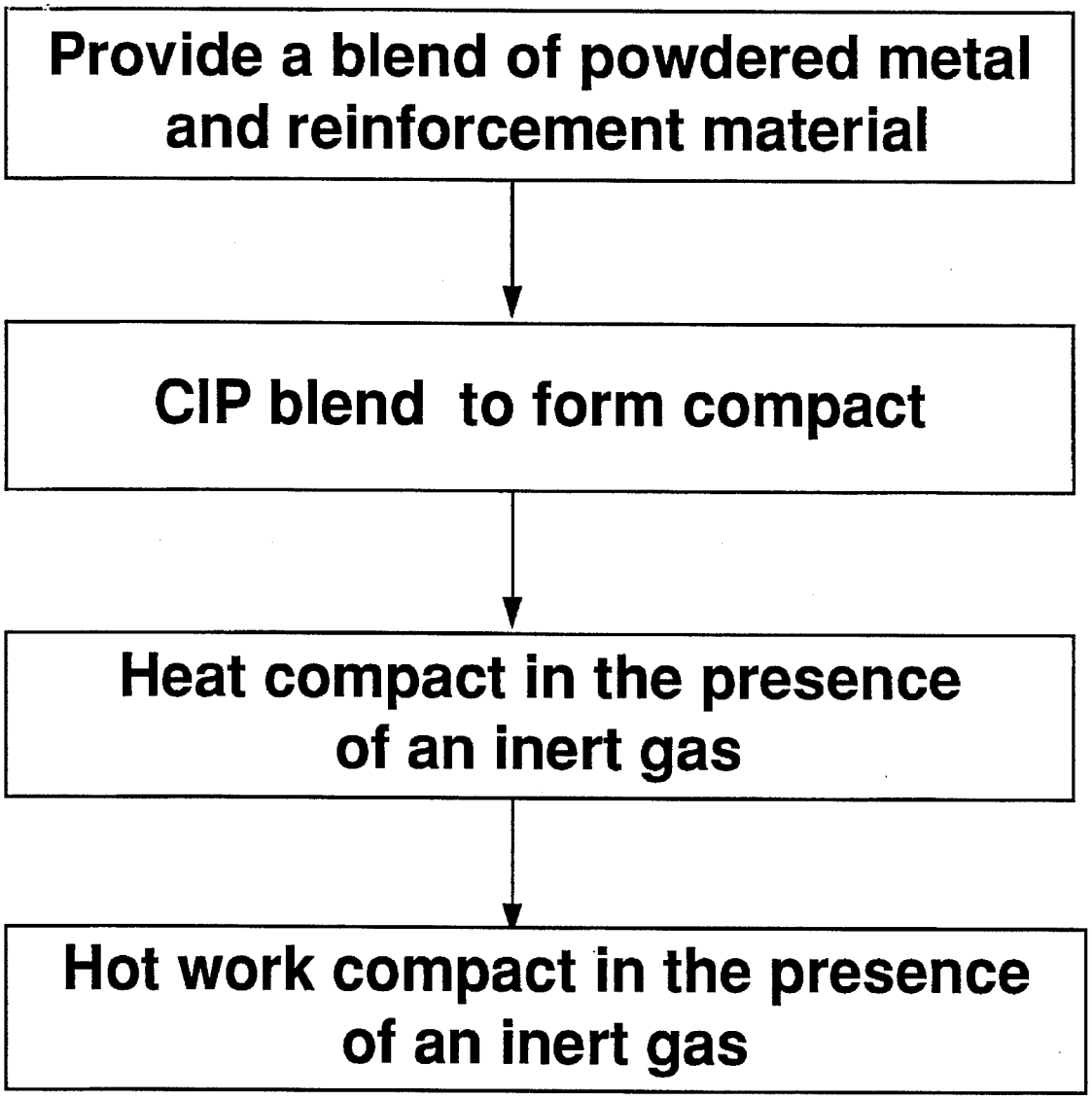
FIG. 1 is a process flow diagram showing the process of the present invention.

Turning first to FIG. 1, there is illustrated a flow chart of major steps in the fabrication of a product formed in accordance with the present invention. The method of the present invention is as follows:

(a) Providing a blend of powdered metal and reinforcement material.

A blend is provided which contains at least two components. The first component is a metal and the second is a material that is harder than the metal. As will be explained below, the second component must be harder than the metal at the elevated temperatures used during the hot working steps. Since the second component is harder than the metal, is referred to herein as a reinforcement material.

In a preferred embodiment the metal is an aluminum alloy containing at least 75 wt. % aluminum metal. Generally, the aluminum alloy powder will consist essentially of particles having 90% less than –325 mesh, and having a gradation of sizes. Preferably, overly coarse powder particles are eliminated by scalping through about a 40 U.S. Standard (USS) mesh sieve.

Typically, the second powder component will be a particulate powder. However, it is the hardness of the second component and not its shape that is critical to the invention. The second component may be irregularly shaped or may take the form of regularly shaped particles, whiskers, fibers, or plates. In addition, the second component may be formed from a mixture of particulate and irregularly shaped materials.

The second material may be a metal, cermet, ceramic or a mixture of cermets, metals, ceramics and or and mixtures thereof. Preferably, the second component is a ceramic material such as silicon carbide, silicon nitride, SiAlON, titanium nitride, titanium carbide, titanium silicide, molybdenum silicate, nickel aluminate, boron carbide, aluminum oxide, magnesium oxide, and silicon.

(b) Producing a compact by the application of pressure to the powder blend.

The blend of powdered metal is cold pressed to form a compact. The term "cold pressed" is used to mean that the blend of material can be pressed at room temperature. However, the term is not intended to limit the invention to pressing at room temperature. The blend of material need not be pressed at room temperature but may be pressed at a temperature above or below room temperature. The key is that the pressing need not be performed at elevated temperatures.

In addition, the cold pressing may be cold isostatic pressing (CIP) or it may be other cold pressing techniques known in the art. The shape of the formed compact may be any shape conductive to downstream processing. Preferably, the shape of the formed compact is similar to that of the final shape.

There is no need to de-air the blend prior to forming the compact and the forming operation may be formed in ambient atmosphere. The compact should have a density which is about 60% or more, preferably about 75% or more, of the theoretical density of the alloy being used, but generally less than about 95%.

After the compact is formed it may be stored for an indefinite length of time before preheating and hot working.

(c) Heating the compact in the presence of an inert gas.

Next, the compact is heated to about 650° F.–950° F. to prepare the compact for hot working. Elevating the temperature of the compact lowers its resistance to deformation and increases its ability to flow.

The compact is heated. The compact may be heated in air or in the presence of an inert gas. Gases that have been found to be useful are nitrogen, argon, and mixtures thereof. Typically, the heating step is of sufficient duration to permit the compact to be uniformly heated throughout its cross sectional area. The duration of the heating step will vary with the size of the compact, the density of the compact and the thermal conductivity of its constituents.

The preheat temperature is below the melting point of the lowest melting point constituent of the compact. Typically, the preheat temperature is below the melting point of the metal. In preheating compacts containing aluminum alloys a preheat temperature of between 650° F. and 950° F. has been found useful.

(d) Hot working the compact.

After the compact has been adequately preheated it is hot worked or molded to produce a full density wrought product. The compact may be formed into a billet or shaped as desired. The hot working may take the form of hot compacting, conventional forging, upset forging, extrusion or rolling.

After hot working, the fully dense material may be conventionally solution heat treated, quenched and artificially or naturally aged to achieve characteristics of high strength, fatigue resistance and toughness and good resistance to stress corrosion cracking.

Figure 2:
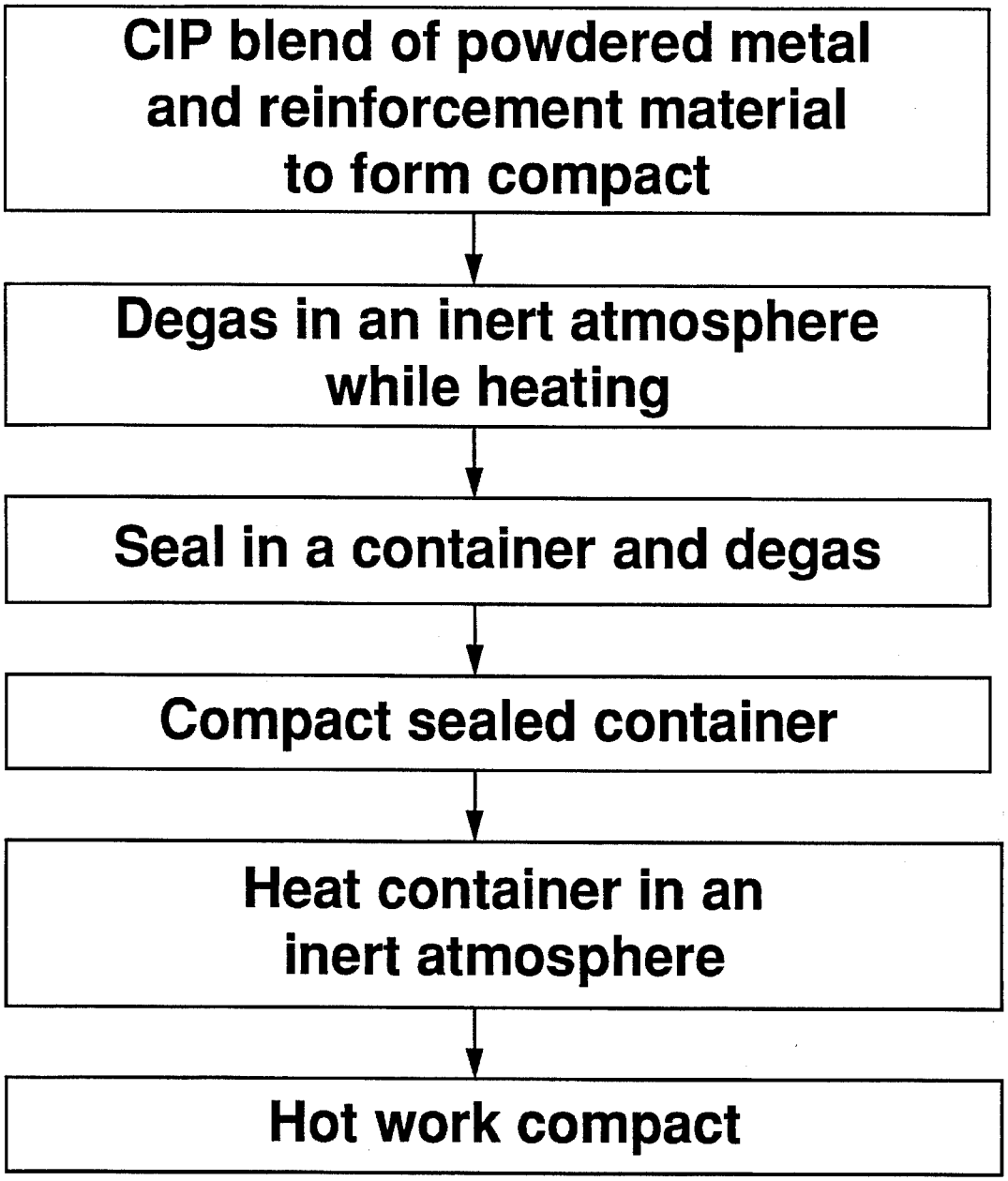
FIG. 2 (prior art)
FIG. 2 is a process flow diagram showing a process of the prior art.
Figure 3:
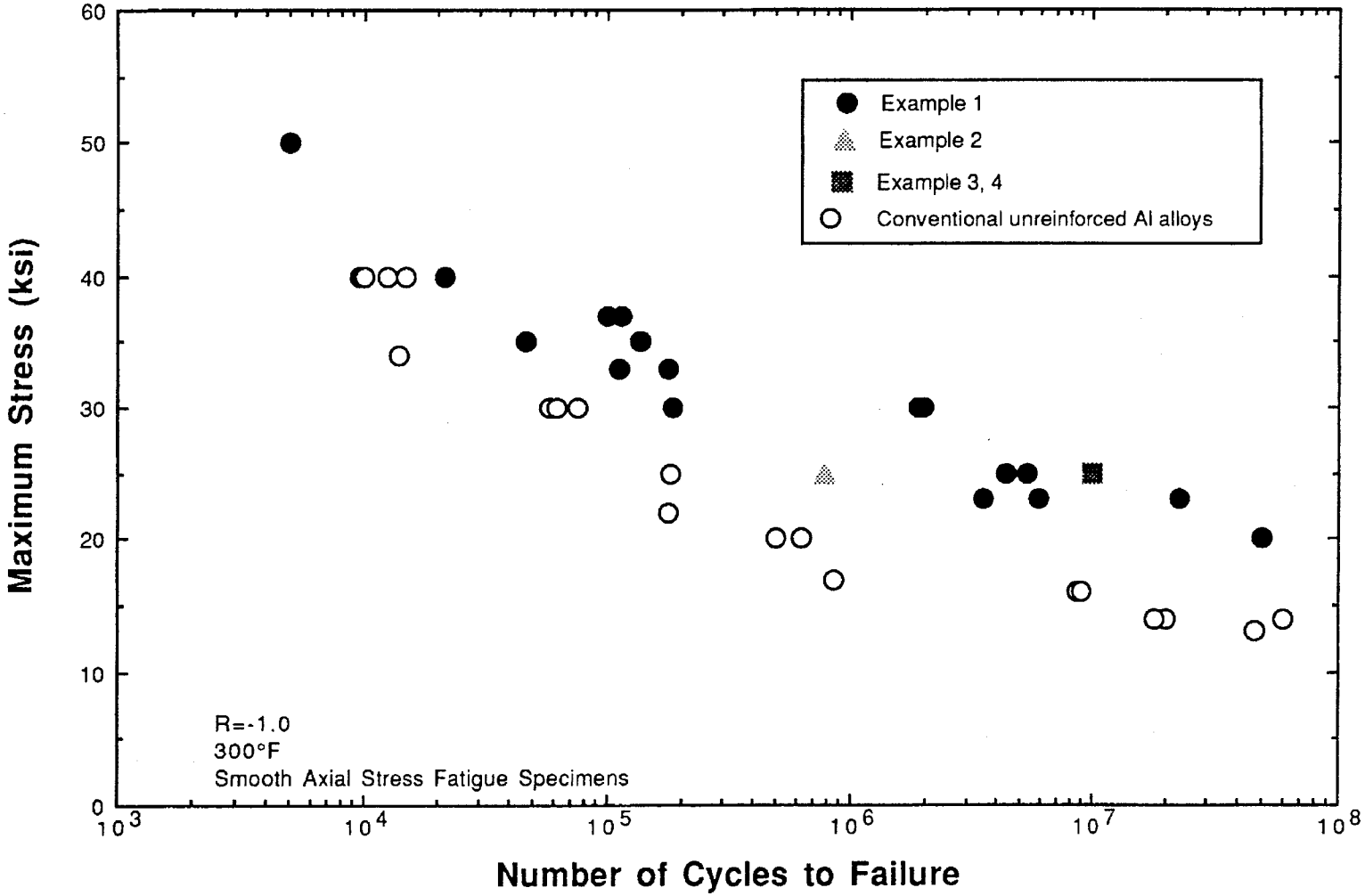
FIG. 3 is a graph comparing smooth axial stress fatigue data of traditional aluminum alloys hot press material billet produced by the present invention on hot pressed and extruded material produced by the present invention.

Those skilled in the art will recognize that the process of the present invention eliminates the costly steps of vacuum degassing the compact, sealing the degassed compact in a gas tight container, compacting the container and removing the container after compact to full density to expose uncontaminated but fully consolidated material. These steps are illustrated in the prior art process of FIG. 2 and discussed above in the "background art". A special advantage is that the encapsulating container does not have to be removed, with its attendant mixed scrap generation. Another advantage is that the process may be conveniently carried out using a conventional, simple furnace, wherein pressures and temperatures can be readily monitored.

Surprisingly, the product formed by the process of the present invention has adequate ductility, fatigue, resistance, toughness and strength to be used as structural members. Heretofore, encapsulating an aluminum powder compact in a container or canister under vacuum has been considered be essential to forming products formed from powder alloy blends that have sufficient toughness and strength that it can be used as a load bearing member.

Although not wishing to be bound by any theory, it is believed that during the hot working the hard second component abrades the oxide film on the aluminum alloy which inhibits the particle-to-particle bonding necessary to form structural products. The abrasion destroys the oxide film during hot working and is believed to produce the unexpected products formed from powder alloy blend having sufficient mechanical performance in the material so that it can be used as a load bearing member.

The benefit of the present invention is illustrated in the following examples. The first example was performed for the purpose of comparison.

EXAMPLE 1 (PRIOR ART)

Powder blend of an aluminum alloy and silicon carbide is cold isostatic pressed to form a porous compact of about 75% of the theoretical density. The aluminum alloy is AA X2080 and the SiC phase is a 20 vol. % addition.

The compact is encapsulated in a closely fitting aluminum alloy container or can. For degassing purposes, air is then evacuated from the can and the compact is heated in a vacuum. While this temperature and vacuum continue to be maintained inside the can, the canned compact is sealed and then compressed to full density at pressures using a 2500 ton press at elevated temperature.

The compact is then cooled and the container is machined away to expose uncontaminated but fully consolidated billet. The billet is given a heat treatment and artificial age to achieve a T6 temper. The smooth axial stress fatigue life of the material was tested at 300° F. at 25 ksi with an R ratio of −1.0 and determined to be on the order of 10,000,000 cycles. The properties of the material of Example 1 are set forth in the Table.

TABLE

| Example No. | Orientation | Tensile Strength (ksi) | Yield Strength (ksi) | Elongation (%) | Toughness (KSIVin) | Fatigue Life (Cycles to failure) |
|---|---|---|---|---|---|---|
| 1 | radial | 75.9 | 60.5 | 2.0 | 19.4 | $1 \times 10^7$ |
| | axial | 75.5 | 60.1 | 1.9 | 19.5 | |
| 2 | radial | 70.3 | 62.1 | 1.65 | 15.1 | |
| | axial | 72.0 | 63.5 | 0.425 | 15.7 | $7.8 \times 10^5$ |
| 3 | radial | 75.9 | 60.6 | 4.0 | 17.3 | |
| | axial | 75.9 | 61.6 | 6.0 | 18.4 | $>1 \times 10^7$ |
| 4 | radial | 75.3 | 60.8 | 4.8 | | |
| | axial | 75.8 | 61.2 | 4.8 | | $>1 \times 10^7$ |

EXAMPLE 2

A blend of material used in Example 1 is cold isostatic pressed to form a porous compact of about 75% of the theoretical density. The compact is heated in a furnace in the presence of argon gas until it is uniformly heated. Afterwards the heated compact is hot compacted on a forging press to produce a wrought product. The product is then given a heat treatment and artificial age to achieve a T6 temper. The properties of the product of Example 2 are measured and are set forth in the Table.

As can be seen from the Table, product of the process of Example 2 exhibited tensile and yield strengths similar to the material produced by the prior process of Example 1. As explained above, process of Example 2 eliminates the costly steps of vacuum degassing the compact, sealing the degassed compact in a gas tight container, compacting the container and removing the container after compacting to full density. As shown in the Table, fatigue life of the material of Example 2 is slightly reduced from shown in the Table, fatigue life of the material of Example 2 is slightly reduced from examples 1, 3 and 4, but still superior to conventional unreinforced aluminum alloys.

EXAMPLE 3 AND 4

A blend of material used in Example 1 is cold isostatic pressed to form a porous compact of about 75% of the theoretical density. The compact is heated in the presence of argon gas and hot compacted by forging press to produce a wrought product as in Example 2. The forged product is then extruded to form 1 inch diameter rods. The rods were then given a heat treatment and artificial age to achieve a T6 temper. The properties of the product of Example 3 and 4 are measured and are set forth in the Table. These are typical properties for this wrought alloy.

As can be seen from the Table, product of the process of Example 3 and 4 exhibited tensile and yield strengths similar to the material produced by the prior process of Example 1. In addition, the toughness of the material of Example 3 and 4 was found to be higher than that of Example 2 and thus closer to the toughness of the more costly prior art process. The fatigue life of the material of Example 3 and 4 was tested at 350° F. at 25 ksi and an determined to be on the order of 10,000,000 cycles.

It is to be appreciated that certain features of the present invention may be changed without departing from the present invention. Thus, for example, it is to be appreciated that although the preferred embodiments of the present invention have been described above in terms of being especially valuable in producing parts from a pre-alloyed blend of X2080 aluminum alloy powder and silicon carbide, it will be apparent to those skilled in the art that the present invention will also be valuable in producing parts from blends of elemental powders and a reinforcement phase. In this embodiment the alloy phase of the product is formed insitu. Those skilled in the art will also recognize that the alloy phase may be formed in situ from a mixture of elemental powders and pre-alloyed powders. In this embodiment, the pre-alloyed powder will have composition which differs from the alloy of the final product.

In addition, although the preferred embodiments of the present invention have been described above in terms of being especially valuable in producing X2080 aluminum alloy parts, it will be apparent to those skilled in the art that the present invention will also be valuable producing parts made of other aluminum alloys containing about 75 percent or more by weight of aluminum and one or more alloying elements. Among such suitable alloying elements is at least one element selected from the group of essentially character forming alloying elements consisting of manganese, zinc, beryllium, lithium, copper, silicon and magnesium. These alloying elements are essentially character forming for the reason that the contemplated alloys containing one or more of them essentially derive their characteristic properties from such elements. Usually the amounts of each of the elements which impart such characteristics are, as to each of magnesium and copper, about 0.5 to about 10 wt. % of the total alloy if the element is present as an alloying element in the alloy; as to the element zinc, about 0.05 to about 12.0% of the total alloy if such element is present as an alloying element; as to the element beryllium, about 0.001 to about 5.0% of the total alloy if such element is present as an alloying element; as to the element lithium, about 0.2 to about 3.0% of the total alloy if such element is present as an alloying element; and as to the element manganese, if it is present as an alloying element, usually about 0.15 to about 2.0% of the total alloy.

The elements iron and silicon, while perhaps not entirely or always accurately classifiable as essentially character-forming alloy elements, are often present in aluminum alloy in appreciable quantities and can have a marked effect upon the derived characteristic properties of certain alloys containing the same. Iron, for example, which if present and considered as an undesired impurity, is sometimes desirably present and adjusted in amounts of about 0.3 to 2.0 wt. % of the total alloy to perform specific functions in certain alloys. Silicon may also be so considered, and while found in a range varying from about 0.25 to as much as 15%, is found in the range of about 0.3 to 1.5% to perform specific functions in certain alloys. In light of the foregoing dual nature of these elements and for convenience of definition, the elements iron and silicon may, at least when desirably present in character affecting amounts in certain alloys, be properly also considered as character forming alloying ingredients.

Such aluminum and aluminum alloys, which may contain one or more of these essential character forming elements, may contain, either with or without the aforementioned character forming elements, quantities of certain well known ancillary alloying elements for the purpose of enhancing particular properties. Such ancillary elements are usually chromium, nickel, zirconium, vanadium, titanium, boron, lead, cadmium, bismuth, and occasionally silicon and iron. Also, while lithium is listed above an essential character forming element, it may in some instances occur in an alloy as an ancillary element in an amount within the range outlined above. When one of these ancillary elements is present in the aluminum alloy of the type herein contemplated, the amount, in terms of percent by weight of the total alloy, varies with the element in question but is usually about 0.05 to 0.4%, titanium about 0.01 to 0.25%, vanadium or zirconium about 0.05 to 0.25%, boron about 0.0002 to 0.04%, cadmium about 0.05 to 0.5%, and bismuth or lead about 0.4 to 0.7%.

The aluminum alloys included most preferably the wrought and forged aluminum alloys such as those registered with the Aluminum Association by the designations 2011, 2014, 2017, 2117, 2218, 2616, 2219, 2419, 2519, 2024, 2124, 2224, 2025, 2036, 2080, 4032, 6101, 6201, 6009, 6010, 6151, 6351, 6951, 6053, 6061, 6262, 6063, 6066, 6070, 7001, 7005, 7010, 7016, 7021, 7029, 7049, 7050, 7150, 7055, 7075, 7175(b), 7475, 7076, 7178, X7093 and other appropriate alloys of similar designation. These aluminum alloys generally include the generic designation 2000 series alloys, 6000 series alloys and 7000 series alloys.

Of particular interest will be the high strength heat-treatable alloys from the 2000 series, i.e., alloys containing about 2.5 to 6.5% Cu and up to about 2.0 wt. % Mg, and from the 7000 series, i.e. alloys containing about 4.0 to 12.0 wt. % Zn and about 1.0 to 4.0% Mg. After hot working, these alloys can be conventionally solution heat treated, quenched and artificially or naturally aged to achieve characteristics of high strength and toughness and good resistance to stress corrosion cracking.

It is also to be appreciated that although the invention has been described in terms of invention has been described in terms of a preferred embodiment in which the metal is an aluminum alloy, other metals may also be used. The invention will also find special utility with regard to magnesium alloys. In addition, alloys of copper, steel, titanium and nickel may also be used in the present invention.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of preparing a metal alloy product from a powder blend, said method comprising:

(a) forming a blend by mixing a metal powder phase and at least one reinforcement phase having a hardness greater than said metal powder at temperatures greater than 650° F. and consisting essentially of a gradation of particles sizes having 90% less than minus 325 mesh, said metal powder having an oxide coating on its surface;

(b) cold pressing said blend to form a compact without mechanically alloying said blend prior to said cold pressing;

(c) heating said compact to a temperature greater than about 650° F. to form a preheated compact; and (d) hot working said preheated compact to abrade said oxide coating on said metal powder and thereby increase the particle-to-particle bonding and provide a multi-phase worked product containing reinforcement material.

2. The method of claim 1 in which said metal is selected from the group consisting of aluminum, magnesium, copper, iron, zinc, nickel, cobalt, titanium, and alloys thereof.

3. The method of claim 1 in which said reinforcement phase is selected from the group of aluminum, magnesium, copper, iron, zinc, nickel, cobalt, titanium, and alloys thereof, cermets, ceramic materials and mixtures thereof.

4. The method of claim 1 in which said reinforcement phase is selected from the group of particulate, whiskers, fibers, and mixtures thereof.

5. The method of claim 1 in which said reinforcement phase is selected from the group consisting of silicon carbide, silicon nitride, SiAlON, titanium nitride, titanium carbide, titanium silicide, molybdenum silicide, nickel aluminate, boron carbide, aluminum nitride, aluminum oxide, magnesium oxide, silicon and mixtures thereof.

6. The method of claim 1 in which said metal powder blend comprises:

50 to 90 vol. % of a metal powder phase; and 10 to 50 vol. % of a reinforcement phase having a hardness greater than said metal.

7. The method of claim 1 in which said metal powder phase comprises:

a pre-alloyed powder.

8. The method of claim 1 in which said metal powder phase comprises:

a mixture containing at least one elemental powder.

9. The method of claim 1 in which (b) includes:

cold pressing to form a compact having a density of about 60% to about 95% theoretical density.

10. The method of claim 1 in which (b) includes:

cold pressing to form a shaped compact.

11. The method of claim 1 in which (c) includes:

heating said compact in the presence of an atmosphere comprising at least about 70 vol. % of an inert gas selected from the group consisting of nitrogen, argon, and mixtures thereof.

12. The method of claim 1 in which (c) includes:

heating the compact in air.

13. The method of claim 1 in which (c) includes:

heating said compact to a temperature of about 650° F. to about 950° F.

14. The method of claim 1 in which (c) further includes:

hot compacting said preheated compact.

15. The method of claim 1 in which (d) includes:

forging said preheated compact.

16. The method of claim 1 in which (d) includes:

forging or hot compacting said preheated compact to form a product having a density greater than 98% theoretical density.

17. The method of claim 1 in which (d) includes:

extruding said preheated compact to form an extruded product.

18. The method of claim 17 which further includes:

(e) forging said extruded product.

19. The method of claim 17 which further includes:

(e) allowing said extruded product to cool;

(f) heating said extruded product; and (g) forging or extruding said heated extruded product.

20. The method of claim 17 in which (d) includes:

forging said preheated compact to near net shape.

21. The method of claim 17 which further includes:

(e) rolling said extruded product.

22. The method of claim 17 which further includes:

(e) allowing said extruded product to cool;

(f) heating said extruded product; and (g) rolling said heated extruded product.

23. The method of claim 17 which further includes:

(e) allowing said extruded product to cool; and (f) cold rolling said extruded product.

24. A method of preparing a consolidated metal alloy product from a powder blend which has not been mechanically alloyed, said method comprising:

(a) cold pressing a powder metal blend to form a compact, said powder metal blend comprising 50 to 90 vol. % of an aluminum alloy powder and 10 to 50 vol. % of silicon carbide, said silicon carbide particles having a hardness greater than said aluminum alloy powder at temperatures greater than about 650° F. and consisting essentially of a gradation of particles sizes having 90% less than minus 325 mesh, said aluminum alloy powder having an oxide coating on its surface;

(b) heating said compact in the presence of nitrogen to a temperature of about 650° F. to about 950° F. to form a preheated compact;

(c) extruding said preheated compact to abrade said oxide coating on said metal powder and thereby increase the particle-to-particle bonding and form an extrudate; and (d) forging said extrudate to form a multi-phase metal alloy product containing reinforcement material.

25. The method of claim 24 in which (a) includes:

cold pressing said powder metal blend to form a compact having a density of about 60% to about 95% theoretical density.

26. A method of preparing an aluminum alloy product from a pre-alloyed powder blend, said method comprising:

(a) cold pressing a blend to form a compact having a density of about 60% to about 95% theoretical density, said blend comprising particles of an aluminum alloy and at least one reinforcement phase, said at least one reinforcement phase being selected from the group consisting of silicon carbide, silicon nitride, SiAlON, titanium nitride, titanium carbide, titanium silicide, molybdenum silicide, nickel aluminate, boron carbide, aluminum nitride, aluminum oxide, magnesium oxide, silicon and mixtures thereof, each said at least one reinforcement phase having a hardness greater than said aluminum alloy particles at temperatures greater than about 650° F. and consisting essentially of a gradation of particles sizes having 90% less than minus 325 mesh, said aluminum alloy powder having an oxide coating on its surface;

(b) heating said compact to a temperature greater than about 650° F. to form a preheated compact; and (c) hot working said preheated compact to abrade said oxide coating on said metal powder and thereby increase the particle-to-particle bonding and provide an aluminum alloy product containing reinforcement material.

27. The method of claim 26 in which (c) working step is selected from the group consisting of forging, extruding, and rolling.

28. A method of preparing an aluminum alloy product from a pre-alloyed powder blend, said method comprising:

(a) cold pressing a powder metal blend which has not been mechanically alloyed to form a compact having a density of about 60% to about 95% theoretical density, said powder metal blend comprising an aluminum alloy powder and at least one reinforcement phase having a hardness greater than said aluminum alloy at a temperature greater than about 650° F. and consisting essentially of a gradation of particles sizes having 90% less than minus 325 mesh, said metal powder having an oxide coating on its surface, said at least one reinforcement phase is selected from the group consisting of silicon carbide, silicon nitride, SiAlON, titanium nitride, titanium carbide, titanium silicide, molybdenum silicide, nickel aluminate, boron carbide, aluminum nitride, aluminum oxide, magnesium oxide, silicon and mixtures thereof;

(b) heating said compact to a temperature greater than about 650° F. to form a preheated compact; and (c) molding said preheated compact under pressure to abrade said oxide coating on said metal powder and thereby increase the particle-to-particle bonding and form a multi-phase metal alloy product containing reinforcement material.

29. A structural metal alloy product formed by a method comprising:

(a) cold pressing a powder metal blend which has not been mechanically alloyed to form a compact, said powder metal blend comprising an aluminum alloy powder and at least one reinforcement phase having a hardness greater than said aluminum alloy powder and consisting essentially of a gradation of particles sizes having 90% less than minus 325 mesh, said metal powder having an oxide coating on its surface, said at least one reinforcement phase is selected from the group consisting of silicon carbide, silicon nitride, SiAlON, titanium nitride, titanium carbide, titanium silicide, molybdenum silicide, nickel aluminate, boron carbide, aluminum nitride, aluminum oxide, magnesium oxide, silicon and mixtures thereof;

(b) heating said compact in the presence of an inert gas to form a preheated compact; and (c) hot working said hot compact to abrade said oxide coating on said metal powder and thereby increase the particle-to-particle bonding and provide a multi-phase worked product containing reinforcement material.

30. A method of preparing a metal alloy product from a powder blend, said method comprising:

(a) forming a blend by mixing a metal powder phase and at least one reinforcement phase having a hardness greater than said metal powder at temperatures greater than 650° F. and consisting essentially of a gradation of particles sizes having 90% less than minus 325 mesh, said metal powder having an oxide coating on its surface;

(b) cold pressing said blend to form a compact alloying said blend prior to said cold pressing;

(c) heating said compact to a temperature greater than about 650° F. to form a preheated compact; and (d) hot working said preheated compact to abrade said oxide coating on said metal powder and thereby increase the particle-to-particle bonding.

* * * * *